US007261210B2

(12) United States Patent
Hatanaka

(10) Patent No.: US 7,261,210 B2
(45) Date of Patent: Aug. 28, 2007

(54) SHELVING SYSTEM

(75) Inventor: Joji Hatanaka, Shiga (JP)

(73) Assignee: Daifuku Co., Ltd. (JP)

( * ) Notice: Subject to any disclaimer, the term of this patent is extended or adjusted under 35 U.S.C. 154(b) by 428 days.

(21) Appl. No.: 10/521,616

(22) PCT Filed: Jul. 23, 2003

(86) PCT No.: PCT/JP03/09356

§ 371 (c)(1),
(2), (4) Date: Jan. 14, 2005

(87) PCT Pub. No.: WO2004/013022

PCT Pub. Date: Feb. 12, 2004

(65) Prior Publication Data

US 2005/0224427 A1 Oct. 13, 2005

(30) Foreign Application Priority Data

Aug. 1, 2002 (JP) ..... 2002-224287

(51) Int. Cl.
*A47F 3/08* (2006.01)

(52) U.S. Cl. ..... 211/1.51

(58) Field of Classification Search ..... 211/51, 211/1.51, 26, 134, 189; 312/265.1, 257.1; 414/273, 277, 331; 700/213–215, 217, 218
See application file for complete search history.

(56) References Cited

U.S. PATENT DOCUMENTS 5,222,855 A * 6/1993 Bernard et al. ..... 414/331.03
5,828,646 A * 10/1998 Jones ..... 369/30.4
5,872,751 A * 2/1999 Utsumi et al. ..... 369/30.29
6,290,072 B1 * 9/2001 Utsumi et al. ..... 211/41.12
6,449,223 B1 * 9/2002 Kanetsuku et al. ..... 369/30.41
6,974,294 B2 * 12/2005 Pressman et al. ..... 414/331.03

FOREIGN PATENT DOCUMENTS

| | | |
|---|---|---|
| JP | S51-9957 | 4/1976 |
| JP | 59200313 | 11/1984 |
| JP | S60-52492 | 3/1985 |
| JP | H6-43706 | 6/1994 |
| JP | 2000142922 | 5/2000 |
| JP | 2001048314 | 2/2001 |
| JP | 2002087518 | 3/2002 |
| JP | 2003012120 | 1/2003 |
| WO | PCT/ISA/210 | 11/2003 |

* cited by examiner

*Primary Examiner*—Jennifer E. Novosad
(74) *Attorney, Agent, or Firm*—Kusner & Jaffe

(57) ABSTRACT

A shelving system including a plurality of movable shelves (1) installed for back-and-forth movement on a travel path through a travel support device, thereby to handle articles with respect to the movable shelves (1) opposed to a working aisle (S) by using the working aisle (S) opened between the movable shelves (1). Each movable shelf (1) includes a pair of movement detectors (19) disposed in a left-right direction (B) perpendicular to the travel direction (A) of the movable shelves (1). Absolute coordinates of each movement detector (19) are found based on detection signals from the pair of movement detectors (19) of each movable shelve (1). The amount of left-right directional deviation from the travel path (i) of the movable shelves (1) is corrected based on the amount of deviation of the absolute coordinates in the left-right direction (B). Further, the attitude of the movable shelves (1) is corrected to be perpendicular to the travel direction (A) based on positional deviation of the absolute coordinates in the travel direction (A), i.e. traveled distance deviation.

5 Claims, 10 Drawing Sheets

SHELVING SYSTEM

TECHNICAL FIELD

The present invention relates to a shelving system with a plurality of movable shelves.

BACKGROUND ART

Conventionally, the following configuration is proposed for the above type of shelving system.

It is configured so that a constant travel path is arranged in a space within a warehouse or a business office, a plurality of shelves (movable shelves) installed for back and forth movement is arranged on the constant travel path leaving a space for a working aisle, a button for specifying the necessary working aisle when the working aisle is necessary between the movable shelves is provided on the movable shelf opposing, for example, the relevant working aisle, and one or a plurality of movable shelves self-advances along the constant travel path until the space between the movable shelves specified in accordance with the operation of the button reaches the width of the working aisle. Workers or cargo vehicles (e.g., fork lift) enter the working aisle opened between the movable shelves, and handling of articles is performed to the movable shelves opposing such working aisle.

When the movable shelf is self-advanced, a width-deviation correction control is performed so that the movable shelf can move along the travel path. For example, in JP-A 2000-142922, a position reference member (e.g., magnetic tape) is laid along the travel path, and by detecting such position reference member with a contact-subjecting position detector (e.g., magnetic sensor) for each movable shelf, the deviation from the travel path of the movable shelf is detected, and the movable shelf can move along the travel path while correcting the detected deviation.

Further, when the movable shelf is self-advanced, an attitude control is performed to maintain the attitude of the movable shelf in a direction perpendicular to the travel path. For example, in JP-A 2001-48314, the moved distances of both ends in the right-and-left direction at right angles to the travel direction of the movable shelf are each detected by counting a pulse of a pulse encoder coupled to traveling wheels of the movable shelf, and attempt is made to eliminate the difference of the moved distances between such ends, that is, to maintain the attitude of the movable shelf in the direction at right angles to the travel path.

In the above-mentioned conventional configuration, when the movable shelf is self-advanced, in order to achieve a shelving system capable of performing both the width-deviation correction control and the attitude control, the position reference member (magnetic tape) must be laid, and the contact-subjecting position detector (magnetic sensor) for detecting the position reference member must be provided on each movable shelf, and further, two pulse encoders must be arranged on each movable shelf to maintain the attitude of the movable shelf in the direction perpendicular to the travel path, thereby arising a problem of increase in cost.

In the movable shelf in which the position reference member is laid, and the contact-subjecting position detector as well as the pulse encoder are provided, when the movable shelf is moved in a tilted manner, the trajectory of the pulse encoder draws an arc, thereby causing an error between the moved distances of both ends and the moved distance in the travel direction, and arising a problem that an accurate attitude control of the movable shelf can not be performed. Further, when the movable shelf is tilted, an error occurs in the moved distance in the direction at right angles to the travel path detected by the contact-subjecting detector.

It is therefore an object of the present invention to provide a shelving system capable of accurately performing the width deviation correction control and the attitude control of a movable shelf and, further, reducing cost.

DISCLOSURE OF THE INVENTION

The present invention is directed to a shelving system comprising a plurality of movable shelves installed for back-and-forth movement on a travel path through a travel supporting device so as to handle articles with respect to the movable shelves opposing a working aisle by using the working aisle opened between the movable shelves, wherein a pair of movement detecting means for detecting a moved distance in the travel direction and a moved distance in a right-and-left direction for every unit time is arranged in the right-and-left direction at right angles to the travel direction along the travel path of each movable shelf, and control means for controlling the movable shelves is also arranged.

The control means derives absolute coordinates of each movement detecting means by the moved distance in the travel direction and the moved distance in the right-and-left direction each detected by each movement detecting means, corrects (performs width deviation correction control) the deviation in the right-and-left direction from the travel path of the movable shelves involved in the traveling of the movable shelves based on the absolute coordinates, or corrects (performs attitude control) the attitude of the movable shelf in a direction at right angles to the travel direction based on the positional deviation in the travel direction of the absolute coordinates.

According to the above configuration, the width deviation correction control and the attitude control of the movable shelves are accurately performed, and the detecting means for performing the width deviation correction control and the attitude control of the movable shelves may only be one pair of movement detecting means, thereby reducing the cost.

Further, the movement detecting means of the present invention includes light projecting means and image pickup means, where the light is diagonally irradiated from the light projecting means to the floor, and the light reflected by the floor is received by the image pickup means thereby picking up the image of the fine projections or depressions of the floor. Thus, the movement of the position of the picked up fine projections or depressions of the floor is tracked by a distance detecting means, and the moved distance in the travel direction and the moved distance in the right-and-left direction for every unit time are derived.

The movement detecting means of the present invention includes light detecting means and adjusting means in addition to the light projecting means and the image pickup means. The illuminance of the floor is detected by the light detecting means, and when the illuminance of the floor changes, such change is detected by the light detecting means, and the detected illuminance of the floor is input to the adjusting means. The intensity of the light irradiated from the light projecting means is adjusted based on the detected illuminance of the floor by the adjusting means, and the intensity of the light received by the image pickup means is maintained constant. Therefore, the illuminance (contrast) of the fine projections or depressions of the floor detected by the image pickup means is maintained constant and the possibility of distinguishing or not distinguishing the fine projections or the depressions of the floor by the contrast is avoided, and thus the detection error is reduced.

Further, in the movement detecting means of the present invention, the light projecting means and the image pickup means are arranged so that the light irradiated diagonally from the light projecting means to the floor is reflected at approximately 90 degrees at the floor. Thus, the light reflected at the floor is most efficiently received by the image pickup means, and the difference between the light received by the image pickup means and the light not traveling towards the image pickup means due to the fine projections and depressions of the floor becomes clear, thereby improving the precision for detecting the fine projections and depressions of the floor.

In the movement detecting means, the light projecting means is arranged so that the direction of the light irradiated by the light projecting means coincides with the travel direction of the movable shelves, and the fine projections and depressions of the floor are continuously detected along the travel direction of the movable shelves. The detection of the moved distance in the travel direction thereby becomes smooth.

BEST MODE FOR CARRYING OUT THE INVENTION

The present invention will now be described in detail in conjunction with the accompanying drawings.

Figure 1:
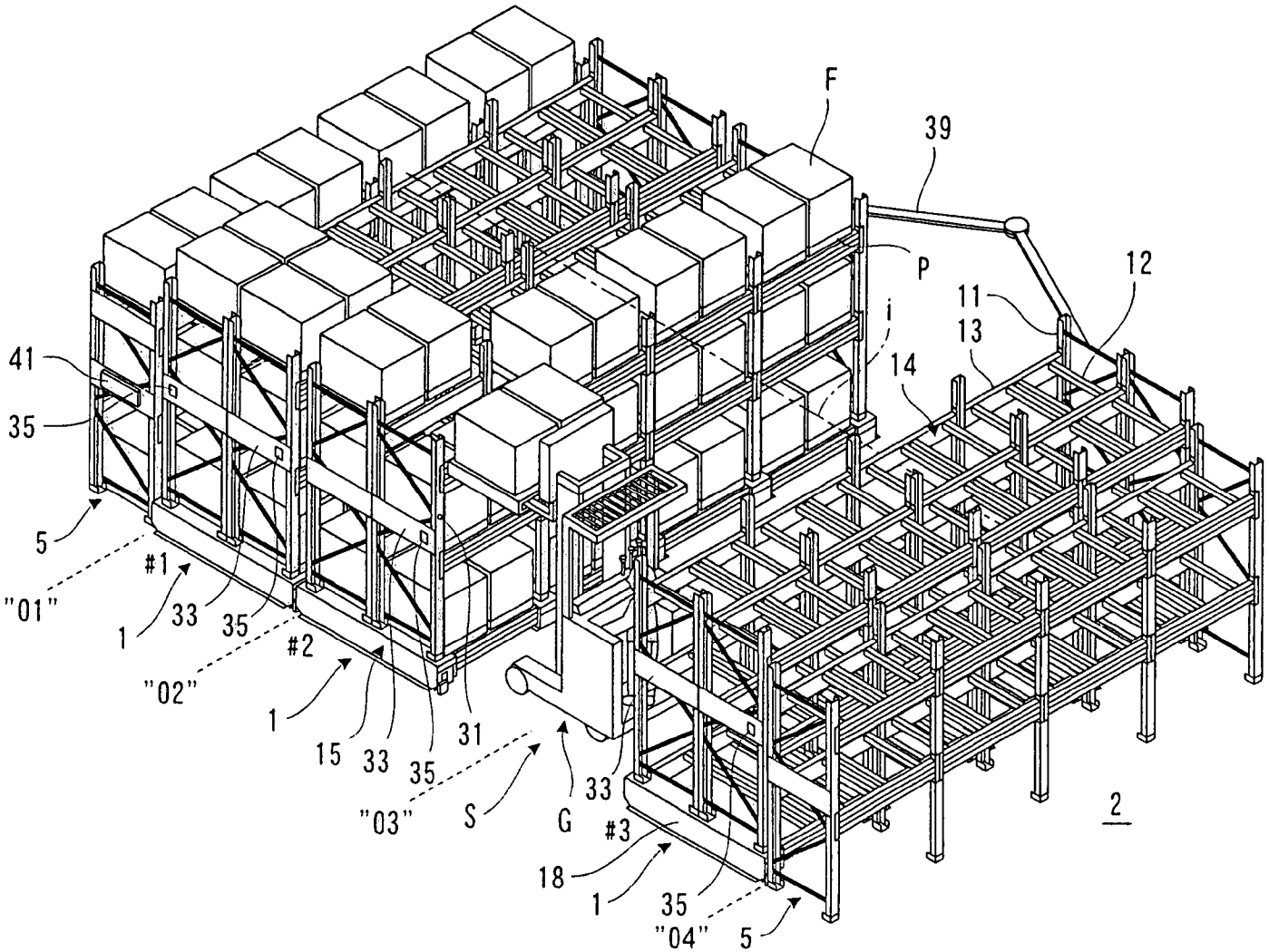
FIG. 1 is a perspective view of a shelving system according to an embodiment of the present invention.
Figure 2:
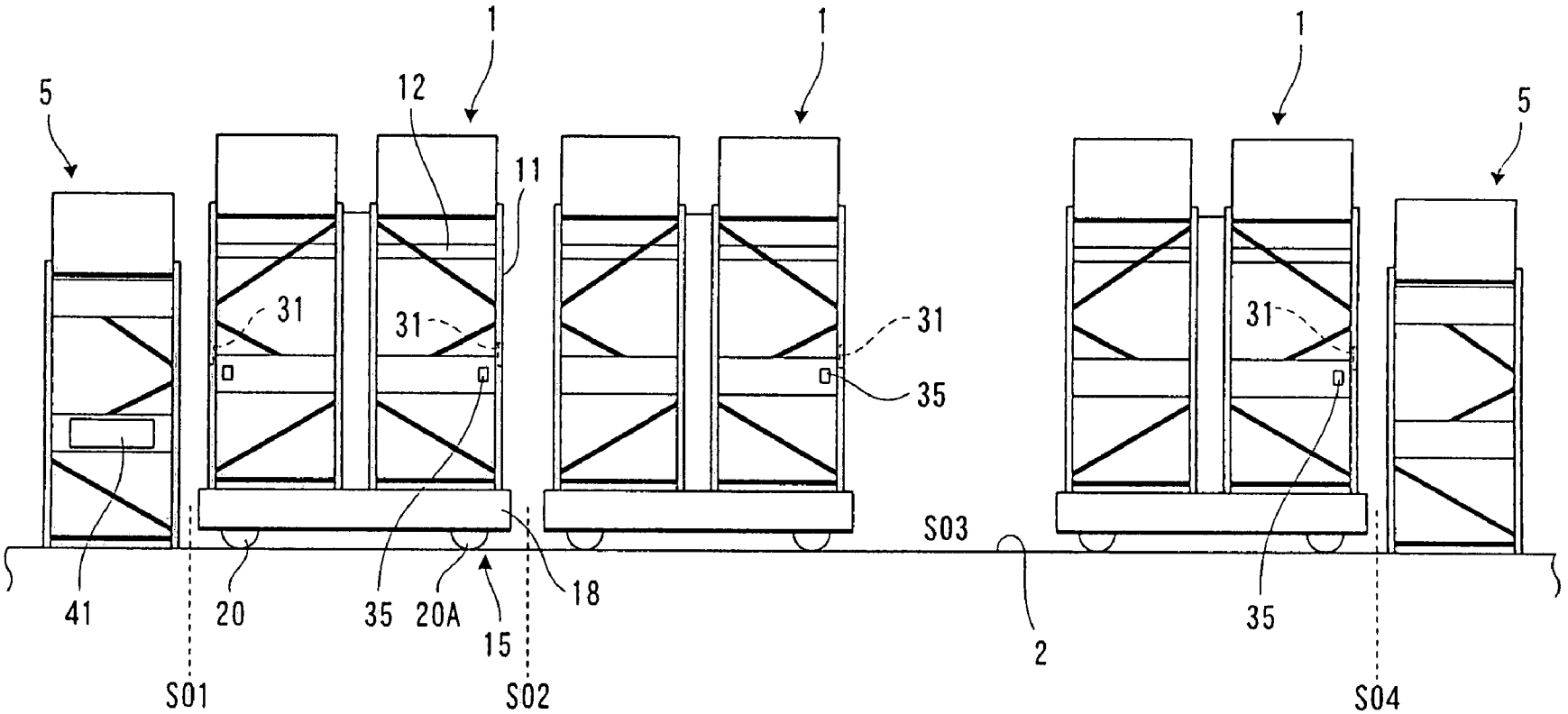
FIG. 2 is a front view of the shelving system.
Figure 3:
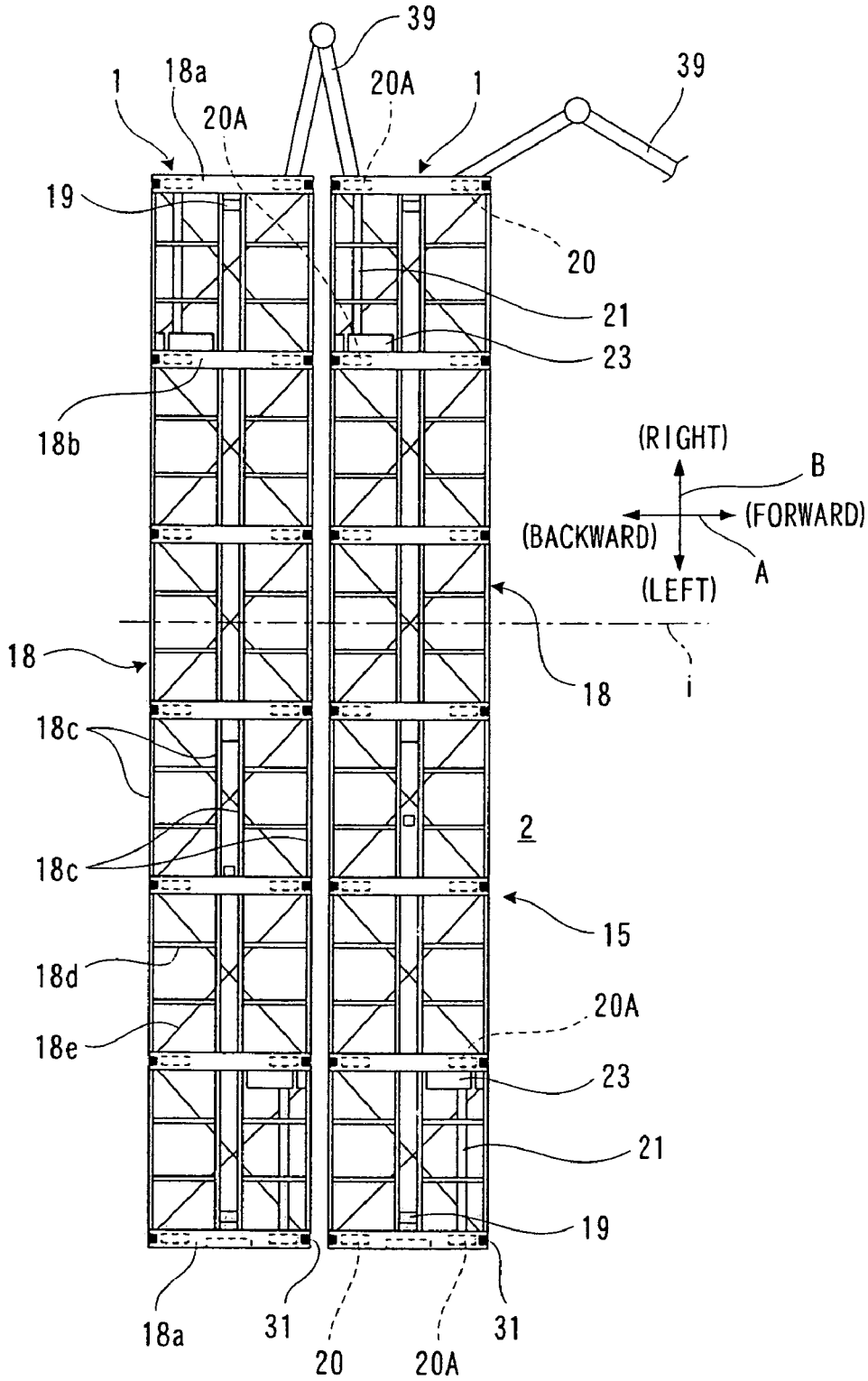
FIG. 3 is a partial plan view of a movable shelf of the shelving system.
Figure 4:
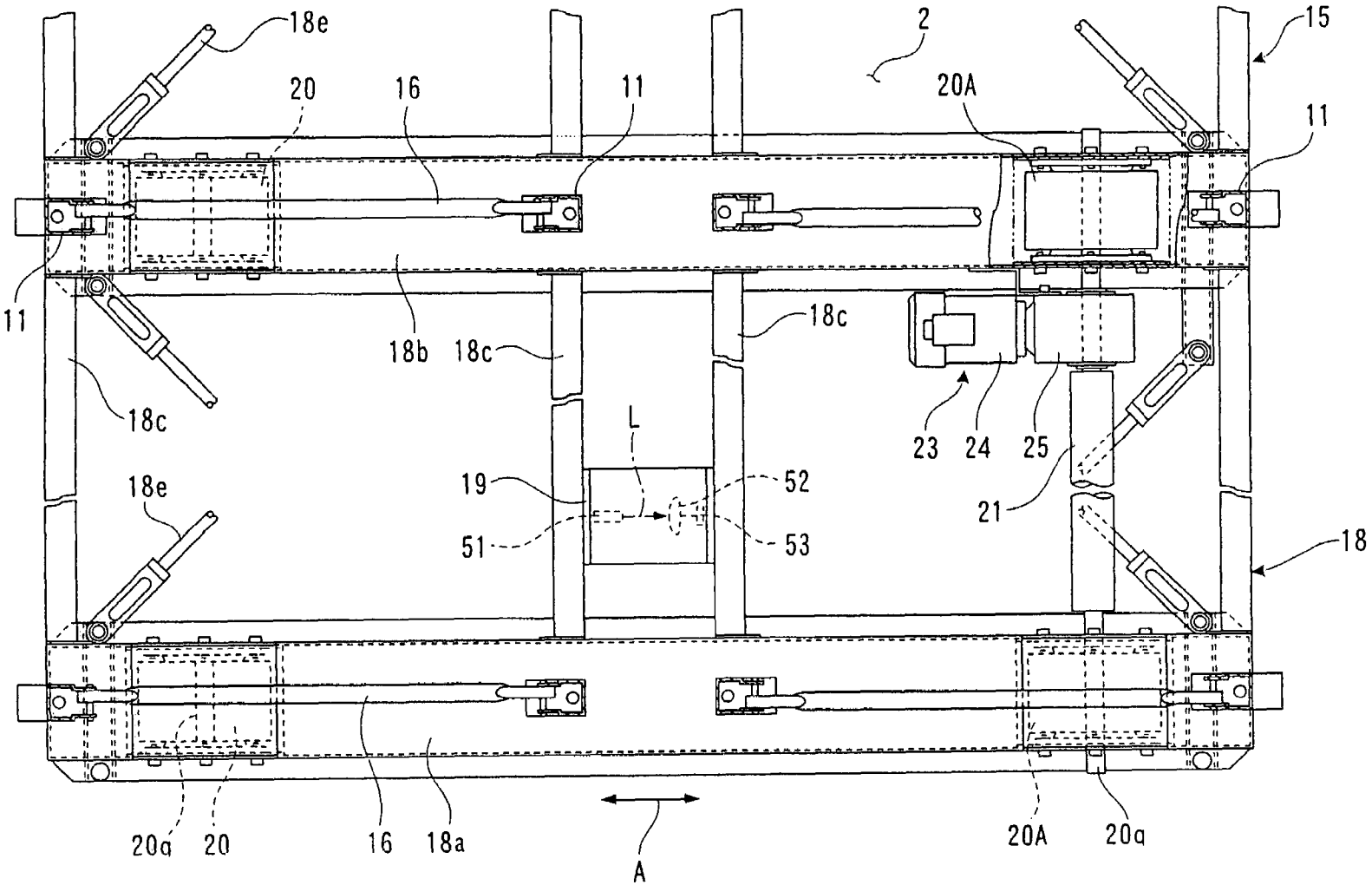
FIG. 4 is a partially cutaway plan view of a main part of the movable shelf of the shelving system.
Figure 5:
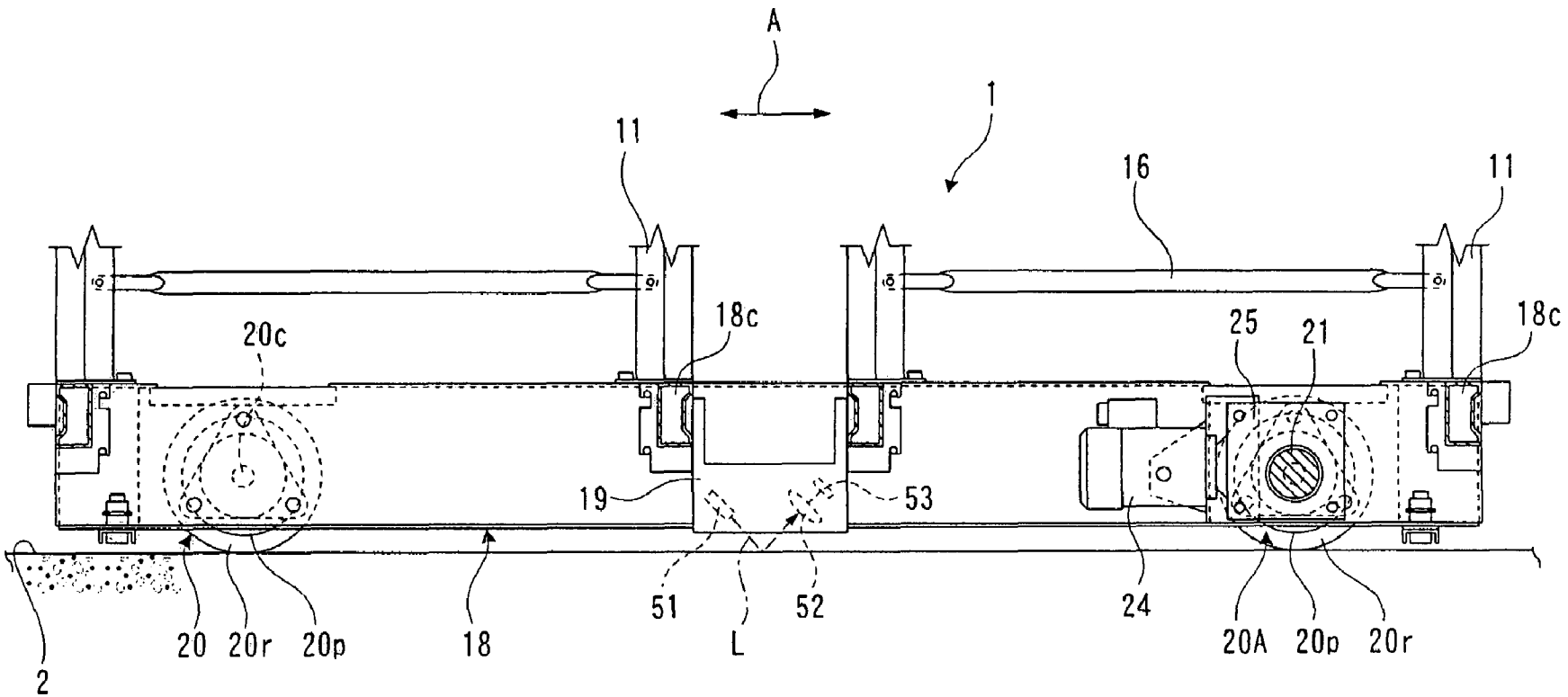
FIG. 5 is a side view of travel driving means and moving means of the movable shelf of the shelving system.

FIG. 1 is a perspective view of a shelving system according to an embodiment of the present invention; FIG. 2 is a front view of a movable shelf of the shelving system; FIG. 3 is a plan view of the movable shelf of the shelving system; FIG. 4 is a partially cut-out plan view of a main part of the movable shelf of the shelving system; and FIG. 5 is a side view of a travel supporting device and a movement detector of the movable shelf of the shelving system.

In FIGS. 1 to 5, a plurality (three in the figure) of a non-rail type movable shelves 1 (hereinafter, referred to as movable shelf) traveling back and forth in a free manner on a floor 2 along a constant travel path i by way of a travel supporting device (to be described later) is arranged on the floor 2. A fixed shelf 5 is arranged on both sides in a direction (hereinafter, referred to as a front-and-back direction) A of the travel path i of a first group of movable shelf 1 while providing an opened working aisle S.

The plurality of movable shelves 1 is referred to as a No. 1 movable shelf 1, a No. 2 movable shelf 1, and a No. 3 movable shelf 3 in the order from the back towards the front in the front-and-back direction A. An aisle number of the working aisle S opened between the fixed shelf 5 at the back and the No. 1 movable shelf 1 is "1", the aisle number of the working aisle S opened between the No. 1 and No. 2 movable shelves 1 is "2", the aisle number of the working aisle S opened between the No. 2 and No. 3 movable shelves 1 is "3", and the aisle number of the working aisle S opened between the No. 3 movable shelf 1 and the fixed shelf 5 at the front is "4".

A plurality of supporting columns 11, a plurality of front-and-back frames 12 coupled across each supporting columns 11 with a predetermined spacing in the up-and-down direction, and a plurality of right-and-left frames 13, coupled in the B direction (hereinafter, referred to as right-and-left direction) at right angles to the travel direction i across each front-and-back frames 12, for supporting a palette P on which an article F is mounted are formed on each movable shelf 1 and each fixed shelf 5. Further, a plurality of article accommodating sections 14 is formed in the up-and-down direction and the right-and-left direction B with the plurality of supporting columns 11, the front-and-back frames 12, and the right-and-left frames 13. The worker uses the working aisle S opened between the movable shelves 1 or between the movable shelf 1 and the fixed shelf 5 at the front or the back to carry out handling of the palette P on which the article F is mounted with a cargo vehicle G such as a fork lift with respect to an article accommodating section 14 of the movable shelf 1 or the fixed shelf 5 facing the working aisle S.

A traveling section (lower frame section) 15 traveling while supporting the plurality of article accommodating sections 14 is arranged on each movable shelf 1. The traveling section 15 is configured by a lower frame body 18, a travel supporting device supported by the lower frame body 18, and two movement detectors (one example of movement detecting means) 19 including an optical mouse encoder arranged on both ends in the right-and-left direction B at the center in the front-and-back direction A of the movable shelf 1 and supported by the lower frame body 18.

As shown in FIGS. 3 to 5, the lower frame body 18 is formed into a rectangular frame by a side lower frame 18*a* positioned on both right and left sides with respect to the front-and-back direction A of the movable shelf 1, an intermediate lower frame 18*b* positioned at five locations (a plurality of locations) on the inner side of the movable shelf 1, four (a plurality of) coupling members 18*c* in the right-and-left direction B coupled between the side lower frame 18*a* and the intermediate lower frame 18*b*, a cross member 18*d* in the front-and-back direction arrange at a plurality of locations between the coupling members 18*c*, a plurality of braces 18*e*, and the like. The side lower frame 18*a* and the intermediate lower frame 18*b* are each formed into a gate shape with an opened lower surface by a pair of side plates and an upper plate arranged between the upper ends of both side plates. The cross section of the coupling member 18*c* and the cross member 18*d* is formed into a rectangular tube shape.

Four supporting columns 11 are erected on each the side lower frames 18*a* of both the right and left sides, and the intermediate lower frames 18*b* at five locations on the inner side (total of 28), and the pair of supporting columns 11 are coupled by a sub-beam 16 (FIG. 5) in the front-and-back direction A.

The traveling wheels 20 are arranged as the travel supporting device at six locations (a plurality of locations) in the right-and-left direction B and at two locations (a plurality of locations) in the front-and-back direction A along the travel path i. The traveling wheels 20 are configured by an inner ring body 20*p* made of metal, and an outer ring body 20*r* made of hard urethane rubber, and is configured so as to freely roll on the floor 2 by way of the outer ring body 20*r*. Further, the two (at least one) traveling wheels on both ends in the right-and-left direction B is cooperatively coupled to travel driving means 23 arranged directly on the lower frame body 18 by passing the linkage shaft 21 to the wheel shaft 20*q* of the traveling wheel, thereby configuring a drive traveling wheel 20A. Each travel driving means 23 is formed by an induction motor 24, and a reduction gear 25 linked to the motor shaft thereof.

An approach detector (one example of approach detecting means) 31 including a reflective photoelectric switch for detecting the approach of the movable shelf 1 or the fixed shelf 5 facing the movable shelf 1 and inhibiting the approaching movement of each other is arranged on the supporting column 11 on the left side lower frame 18*a* and on a surface (hereinafter, referred to as the side surface) facing the working aisle S thereof. The approach detector 31 is arranged at two locations in the front-and-back direction A in the No. 1 movable shelf 1, and at one location at the front in the No. 2 and No. 3 movable shelves 1.

An operation panel 33 is arranged on a surface (hereinafter, referred to as a front surface) formed by the plurality of supporting columns 11 on the left side lower frame 18*a*, and an operation button 35 for selecting and operating the working aisle S for each working aisle S is arranged on the front surface of each operation panel 33. The operation buttons 35 corresponding to the working aisles S1, S2, S3, S4 are referred to as an S1 operation button 35, an S2 operation button 35, an S3 operation button 35 and an S4 operation button 35. The S operation button 35 and the S2 operation button 35 are arranged at both end positions in the front-and-back direction A of the No. 1 movable shelf 1, the S3 operation button 35 is arranged at the front end position of the No. 2 movable shelf 1, and the S4 operation button 35 is arranged at the front end position of the No. 3 movable shelf 1.

A controller (one example of controlling means) 36 (FIG. 6) including a microcomputer, and an inverter 37 (FIG. 6) for driving the motor 24 of each travel driving means 23 are each arranged inside the operation panel 33 of each movable shelf 1.

Figure 6:
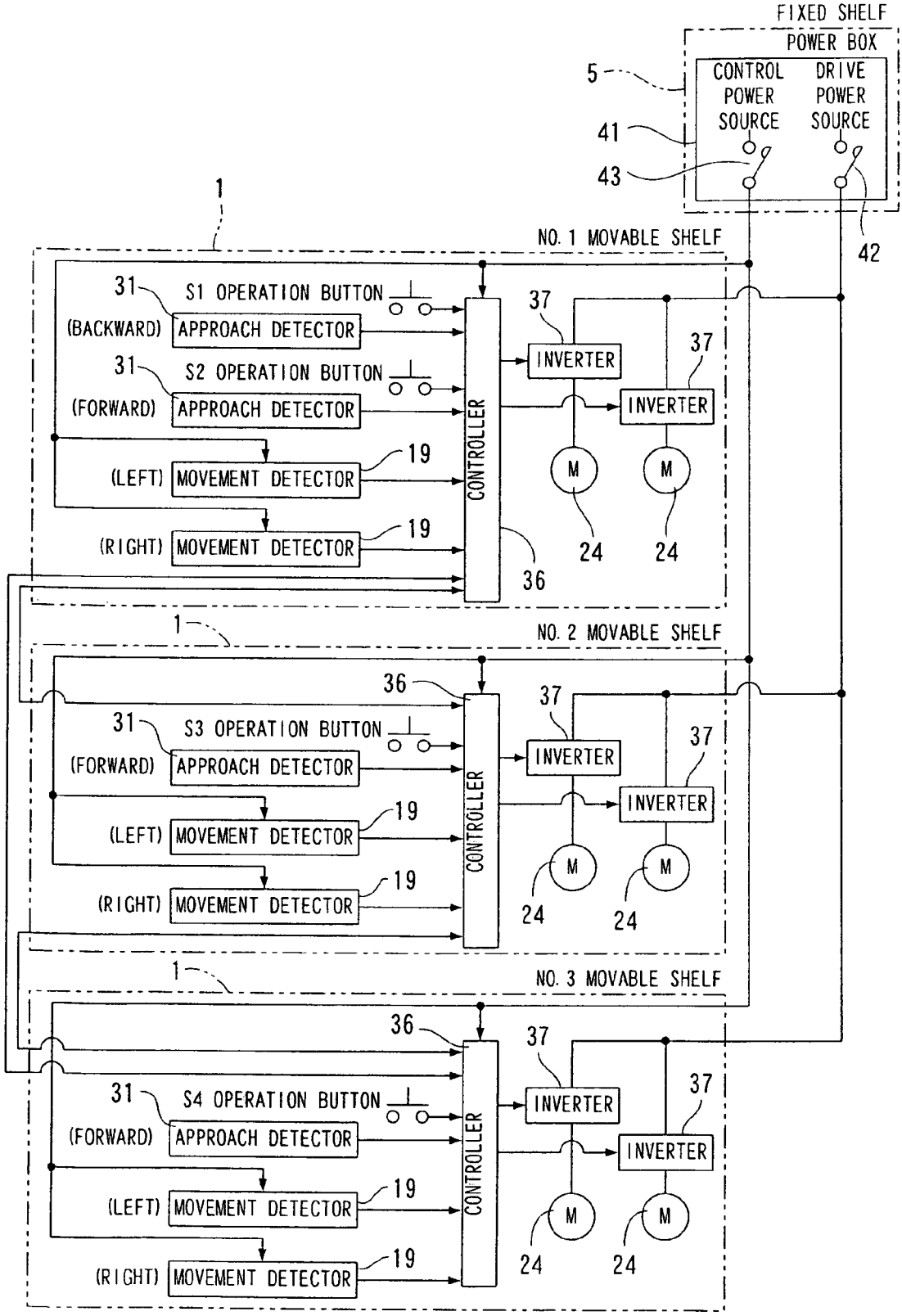
FIG. 6 is a circuit configuration diagram of the shelving system.

As shown in FIG. 6, the two movement detectors 19 on the right and the left, the approach detectors 31, the operation buttons 35, and the two inverters 37 of each movable shelf 1 are connected to the controller 36 of each movable shelf 1, and further, the controllers 36 of each movable shelf 1 are connected to each other. The front and back approach detectors 31 and the front and back S1, S2 operation buttons 35 are connected to the controller 36 of the No. 1 movable shelf 1. The reciprocal drive of the motor 24 is carried out by outputting a motor drive signal (speed command value including move-forward/move-backward signal) to the two inverters 37 from each controller 36, and operating each inverter 37 in response to the motor drive signal. The movable shelf 1 can then be traveled back and forth, and a difference in speed between the right and left motors 24 is created to eliminate the width deviation of the movable shelf 1 and to correct the attitude of the movable shelf 1 (to be described in detail later).

As shown in FIGS. 1 and 3, a horizontal cable arm 39 is retractably arranged between the fixed shelf 5 and the movable shelf 1 and between the movable shelves 1 to supply power to the inverter 37 and the controller 36 and to transmit or receive signals between controllers 36.

Further, as shown in FIGS. 1 and 2, a power box 41 for the shelving system is arranged on the front surface of the back fixed shelf 5. As shown in FIG. 6, an over current circuit-breaker (breaker) 42 for a movable shelf drive power source connected to the commercial power source line (corresponding to the drive power source of each movable shelf 1), a control power source (not shown) for supplying control power to the controller 36 of each movable shelf 1, and an over current circuit-breaker (breaker) 43 for a control power source connected to the control power source device are arranged in the power box 41, where the drive power source and the control power source are supplied to each movable shelf 1 via the breakers 42, 43 and the horizontal cable arm 39.

The configuration and the detecting principle of the movement detector 19 will now be explained with reference to FIG. 7.

As mentioned above, the pair of movement detectors 19 are each arranged on both ends in the right-and-left direction B at the center in the front-and-back direction A of the movable shelf 1, and supported by the coupling member 18*c* at the center of the lower frame body 18. As shown in FIG. 7(*a*), each movement detector 19 is configured by a light emitting diode (LED: one example of light projecting means) 51, a lens 52, an image pickup device (CCD: one example of image pickup means) 53, a distance detector (one example of distance detecting means) 54, a photosensor (one example of light detecting means) 55, an adjusting circuit (one example of adjusting means) 56, and a control power circuit 57.

The light emitting diode 51 diagonally irradiates a pulse light L at about one million times a second so that the direction of light irradiated to the floor 2 where the movable shelf 1 is arranged coincides with the travel direction A of the movable shelf 1.

The lens 52 collects the pulse light L irradiated from the light-emitting diode 51 and reflected by the floor 2.

The image pickup device 53 receives the pulse light L collected by the lens 52, and picks up the image of the fine projections 2*a* and depressions 2*b* of the floor 2.

The arranging positions of the light emitting diode 51, the lens 52 and the image pickup device 53 are adjusted so that the angle δ created by the light irradiated by the light emitting diode 51 and the pulse light L received by the image pickup device 53 by way of the lens 52 is approximately 90 degrees.

The photosensor 55 detects the illuminance of the floor 2 on where the movable shelf 1 is arranged (illuminance of the floor 2 at where the movement detector 19 is arranged).

The adjusting circuit 56, based on the illuminance of the floor 2 detected by the photosensor 55, controls the current value to be provided to the light emitting diode 51 and adjusts the intensity of the light irradiated by the light emitting diode 51 so that the intensity of the pulse light L received by the image pickup device 53 is constant.

The control power circuit 57, connected to the control power source (FIG. 6), adjusts the voltage to a predetermined voltage and supplies it to the distance detector 54 and the adjusting circuit 56.

Figure 7:
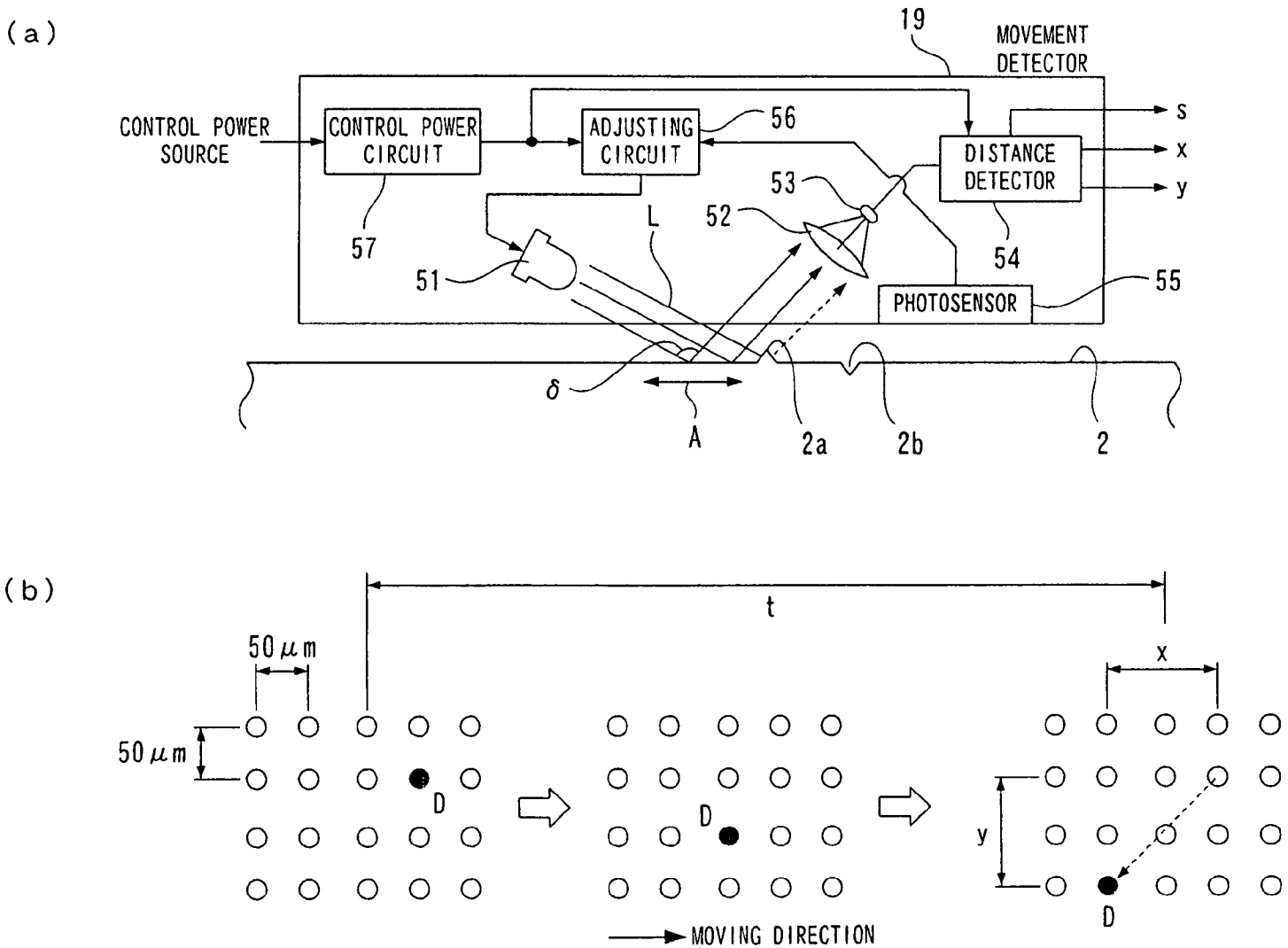
FIG. 7 is an explanatory view of a movement detector of the shelving system.

As shown in FIG. 7(*b*), the distance detector 54 digitalizes the image pickup signal of the image pickup device 53 to a signal level (threshold value) set in advance, and forms a contrast pattern (pattern in which the fine projections 2*a* or depression 2*b* is the dark part). It further stores the position of the pixel D of the image pickup device 53 detecting the projection 2*a* or depression 2*b* in accordance with and for each irradiation of the pulse light L, tracks the position of the pixel D moving in the direction opposite the moving direction along the travel direction A, derives the distance x, y (the distance between the pixels D is set in advance) which the distance detector 54 has moved for each predetermined time t, and outputs the same to the controller 36 with the synchronization signal s. Here, the spacing of the pixel D is equal to or less than about 50 μm, and a problem in the output precision does not occur even if the image pickup device 53 is tilted on the plane surface since the pixel D of the CCD detecting the projection 2*a* and depression 2*b* is tracked in accordance with the irradiation of the pulse light.

In this way, the light is irradiated diagonally with respect to the floor 2 along the travel direction A of the movable shelf 1 from the light-emitting diode 51, and the light reflected by the floor 2 is received by the image pickup device 53. The fine projections 2*a* or depressions 2*b* of the floor 2 in a long range in the travel direction A are thereby imaged, the movement of the position (pixel D) of the fine projections 2*a* or depressions 2*b* of the floor 2 picked up by the image pickup device 53 is tracked by the distance detector 54, and the moved distance x in the travel direction A and the moved distance y in the right-and-left direction B for every unit time t are obtained.

The adjusting circuit 56, based on the illuminance of the floor 2 detected by the photosensor 55, adjusts the intensity of the light irradiated by the light emitting diode 51, and thus the illuminance (contrast) of the fine projections 2*a* or depressions 2*b* of the floor 2 are held constant even if the illuminance of the floor 2 is changed, and the intensity of the light received by the image pickup device 53 is held constant.

The operation of the controller 36 of the movable shelf 1 will now be explained in accordance with the control block diagrams of FIGS. 8 to 10.

Figure 8:
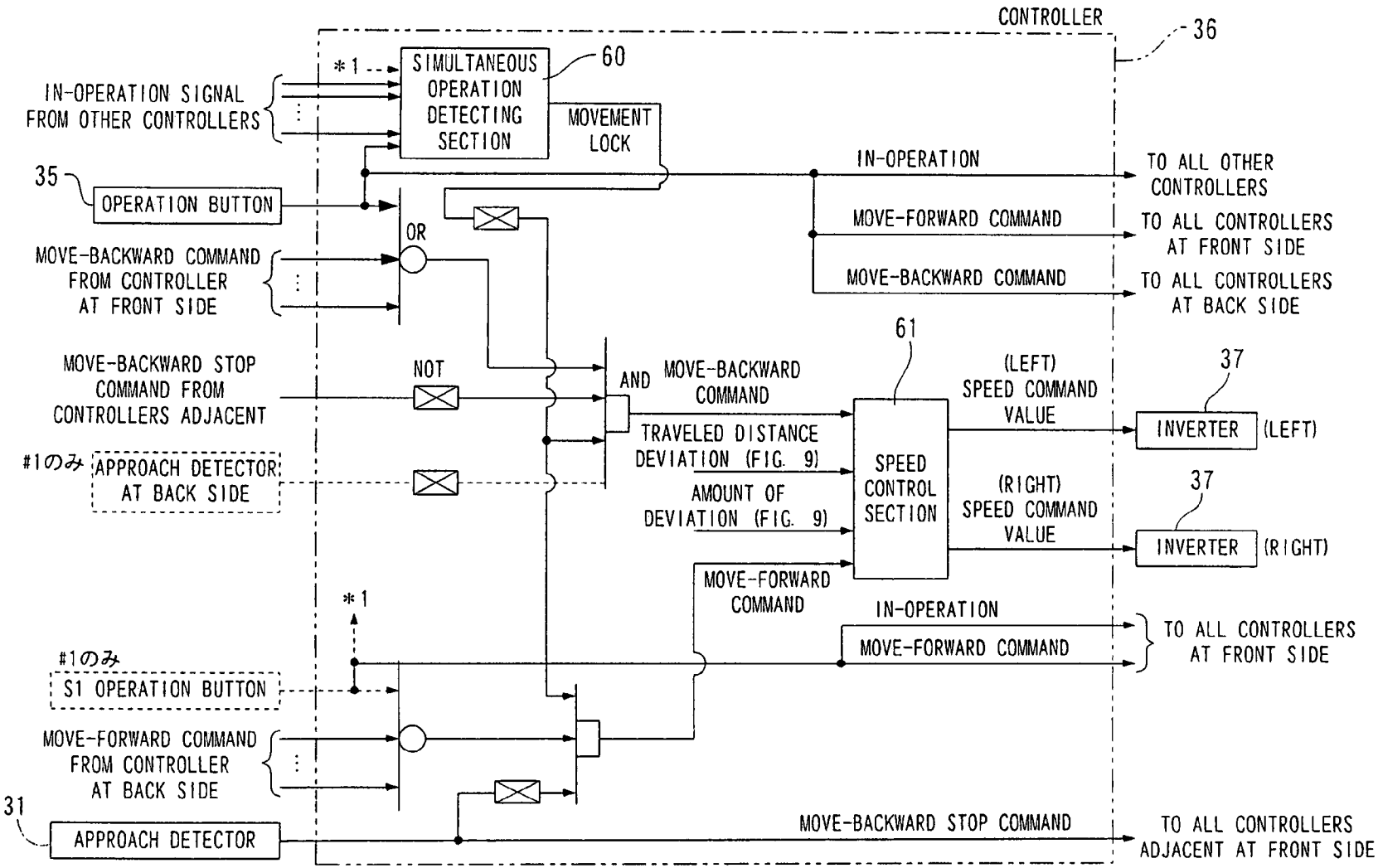
FIG. 8 is a control block diagram of a controller of each movable shelf of the shelving system.
Figure 9:
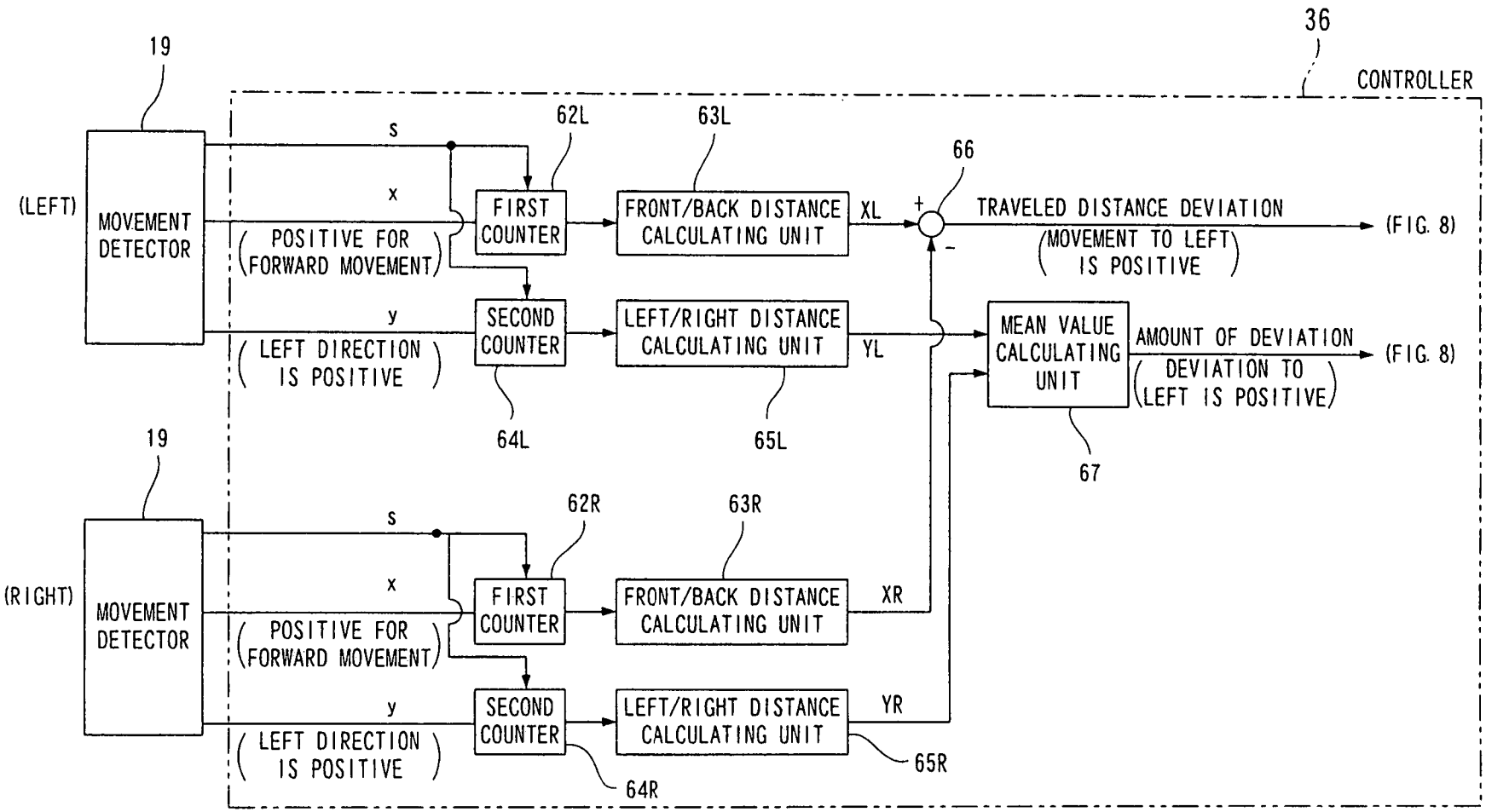
FIG. 9 is a control block diagram of a controller of each movable shelf of the shelving system.

As shown in FIGS. 8 and 9, the controller 36 is configured by a simultaneous operation detecting unit 60, a speed control section 61, first counters 62L, 62R, front/back distance calculating units 63L, 63R on the right and the left, second counters 64L, 64R, left/right distance calculating units 65L, 65R on the right and the left, a calculating unit 66, a mean calculating unit 67, and a plurality of logic circuits.

The first counter 62L on the left counts the distance x for every unit time input from the left movement detector 19 each time the synchronization signal s of the left movement detector 19 is input to the controller 36.

The first counter 62R on the right counts the distance x for every unit time input from the right movement detector 19 each time the synchronization signal s of the right movement detector 19 is input to the controller 36.

The front/back distance calculating unit 63L on the left calculates the front/back moved distance $X_L$ of the position of the movement detector 19 from the counted value of the first counter 62L.

The front/back distance calculating unit 63R on the right calculates the front/back moved distance $X_R$ of the position of the movement detector 19 from the counted value of the first counter 62R.

The second counter 64L on the left counts the distance y for every unit time input from the left movement detector 19 each time the synchronization signal s of the left movement detector 19 is input.

The second counter 64R on the right counts the distance y for every unit time input from the right movement detector 19 each time the synchronization signal s of the right movement detector 19 is input.

The left/right distance calculating unit 65L on the left calculates the left/right moved distance $Y_L$ of the position of the movement detector 19 from the counted value of the second counter 64L.

The left/right distance calculating unit 65R on the right calculates the left/right moved distance $Y_R$ of the position of the movement detector 19 from the counted value of the second counter 64L.

The subtracter 66 subtracts the moved distance $X_R$ of the right movement detector 19 calculated from the front/back distance calculating unit 63R on the right from the moved distance $X_L$ of the left movement detector 19 calculated from the front/back distance calculating unit 63L on the left to derive the traveled distance deviation (movement to the left is positive).

The mean value calculating unit 67 calculates the mean value of the moved distance $Y_L$ of the left movement detector 19 calculated from the left/right distance calculating unit 65L on the left and the moved distance $Y_R$ of the right movement detector 19 calculated from the left/right distance calculating unit 65R on the right to derive the amount of deviation (deviation in the left direction is positive) to the right and the left from the travel path i.

Therefore, the absolute coordinates ($X_L$, $Y_L$) of the left movement detector 19, the absolute coordinates ($X_R$, $Y_R$) of the right movement detector 19, the traveled distance deviation, and the amount of deviation are derived from the detection signals (distance x, y and synchronization signal s) of the right and left movement detectors 19.

The worker operates the S2, S3, S4 operation buttons 35, excluding the S1 operation button 35, and the movable shelves 1 of which operation button 35 is operated, and all the movable shelves 1 on the back side of such movable shelves 1 must move backwards, and all the movable shelves 1 on the front side of the movable shelf 1 of which operation button 35 is operated must move forward to form the working aisle S at the front of the movable shelf 1 of which operation button 35 is operated. When the S1 operation button 35 is operated, all the movable shelves 1 must move forward to form the working aisle S at the back of the No. 1 movable shelf 1. Further, when at least two operation buttons 35 are simultaneously operated, it is determined to be a wrong operation, and the movement of the movable shelf 1 must be locked (stopped).

When the operation command of the S2, S3, S4 operation buttons 35, excluding the S1 operation button 35, is input to the controller 36 of each movement shelf 1, an in-operation signal of the operation button 35 is output to the controller 36 of the other movement shelves 1, and a move-backward command is output to the controllers 36 of all the movement shelves 1 on the back side, and the move-forward command is output to the controllers 36 of all the movement shelves 1 on the front side while the operation command is being input. Further, when the operation command of the S1 operation button 35 is input to the controller 36 of the No. 1 movement shelf 1, the in-operation signal of the operation button 35 is output to the controller 36 of the movement shelves 1 on the front side, and the move-forward command is output while the operation command is being input.

The simultaneous operation detecting unit 60 holds the in-operation signal (operation signal command) of the operation button 35 of the movable shelf 1 provided with the controller 36 and the in-operation signal from the other controllers 36 for a predetermined time, and forms a combination of the in-operation signal of the two operation buttons 35. The logical product (AND) of the operation signals of the two operation buttons 35 held over a predetermined time is obtained for each combination, and the logical sum (OR) of the output of such logical product are taken and then output. Thus, at least two of the operation buttons 35 are detected (determined) whether operated substantially simultaneously, and then output.

The speed control section 61 is input with the move-backward command, which will be described later, the traveled distance deviation, the amount of deviation, and the move-forward command and makes an output with a speed difference between the speed of the two motors 24 so as to correct the attitude of the movement shelf 1 and to eliminate the amount of deviation with the traveled distance deviation.

When the operation command of the operation button 35, or the move-backward command from the controller 36 of the front movable shelf 1 is input to the OR circuit, a check is made by the AND circuit whether the move-backward stop command (to be described later) from the controller 36 of the movable shelves 1 adjacent at the back is input, or whether the output of the simultaneous operation detecting unit 60 is turned ON (ON when at least two operation buttons 35 are determined to be simultaneously operating). Further, when the move-backward stop command from the controller 36 of the adjacent movable shelves 1 is not input, and the output of the simultaneous operation detecting unit 60 is not turned ON, the AND circuit outputs the move-backward command to the speed control section 61.

The speed control section 61, when input with the move-backward command, sets the speed difference of the two motors 24 in accordance with the traveled distance deviation and the amount of deviation, and outputs the motor drive signal (speed command value) to move backwards to the two inverters 37. The movable shelf 1 moves backwards while eliminating the traveled distance deviation and the amount of deviation since each motor 24 is driven backwards by the two inverters 37.

Further, when the move-backward stop command from the controller 36 of the movable shelves 1 adjacent at the back is input to the AND circuit, the move-backward command to the speed control section 61 is turned OFF, and the movable shelf 1 comes to a stop. Even if the operation command of the operation button 35 is input or the move-backward command from the controller 36 of the front movable shelf 1 is input, when the move-backward stop command is being input or when the output of the simultaneous operation detecting unit 60 is turned ON, the move-backward command is not output to the speed control section 61, and the movable shelf 1 remains stopped. When the operation command of the operation button 35 is being input, or when the move-backward command from the controller 36 of the front movable shelf 1 is being input, the move-backward command to the speed control section 61 is produced, and when the operation command of the operation button 35 and the move-backward command from the controller 36 of the front movable shelf 1 are turned OFF, the move-backward command to the speed control section 61 is turned OFF and the movable shelf 1 comes to a stop.

Further, when the move-forward command is input from the controller 36 of the movable shelf 1 at the back to the OR circuit, a check is made by the AND circuit whether the approach detector 31 is operating or not, and whether the output of the simultaneous operation detecting unit 60 is turned ON or not. If the approach detector 31 is not operating and the output of the simultaneous operation detecting unit 60 is not turned ON, the AND circuit outputs the move-forward command to the speed control section 61.

When the move-forward command is input to the speed control section 61, the speed control section 61 corrects the attitude of the movable shelf 1, sets the speed difference of the two motors 24 so as to eliminate the amount of deviation, and outputs the motor drive signal (speed command value) to move forward to the two inverters 37. Each motor 24 is driven forward by the two inverters 37 and thus the movable shelf 1 moves forward while eliminating the traveled distance deviation and the amount of deviation.

When the approach detector 31 is operating, the move-forward command to the speed control section 61 is turned OFF, and the movable shelf 1 comes to a stop. If the approach detector 31 is operating when the move-forward command is input from the controller 36 of the movable shelf 1 at the back, or when the output of the simultaneous operation detecting unit 60 is turned ON, the move-forward command is not output to the speed control section 61, and the movable shelf 1 remains stopped. When the move-forward command is being input from the controller 36 of the movable shelf 1 at the back, the move-forward command to the speed control section 61 is produced, and when the move-forward command from the controller 36 of the movable shelf 1 at the back is turned OFF, the move-forward command to the speed control section 61 is turned OFF and the movable shelf 1 comes to a stop. Further, when the approach detector 31 is operating, the above move-backward stop command is output to the controllers 36 of the movable shelves 1 adjacent at the front.

As mentioned above, when the output of the simultaneous operation detecting unit 60 is turned ON, that is, when two or more operation buttons 35 are almost simultaneously operating (when wrongly operated), both the move-backward command and the move-forward command are not output and the movable shelf 1 remains stopped.

In the controller 36 of the No. 1 movable shelf 1, when the operation signal of the S1 operation button 35 is input, the move-forward command and the in-operation signal are output to the controllers 36 of all the movable shelves 1 on the front side, as mentioned above, and when the approach detector 31 at the front is not operating, the move-forward command is output to the speed control section 61. Further, in the controller 36 of the No. 1 movable shelf 1, when the approach detector 31 at the back is operating, the move-backward command is turned OFF and the backward movement of the movable shelf 1 comes to a stop. The operation signal of the S1 operation button 35 is input to the simultaneous operation detecting unit 60.

Figure 10:
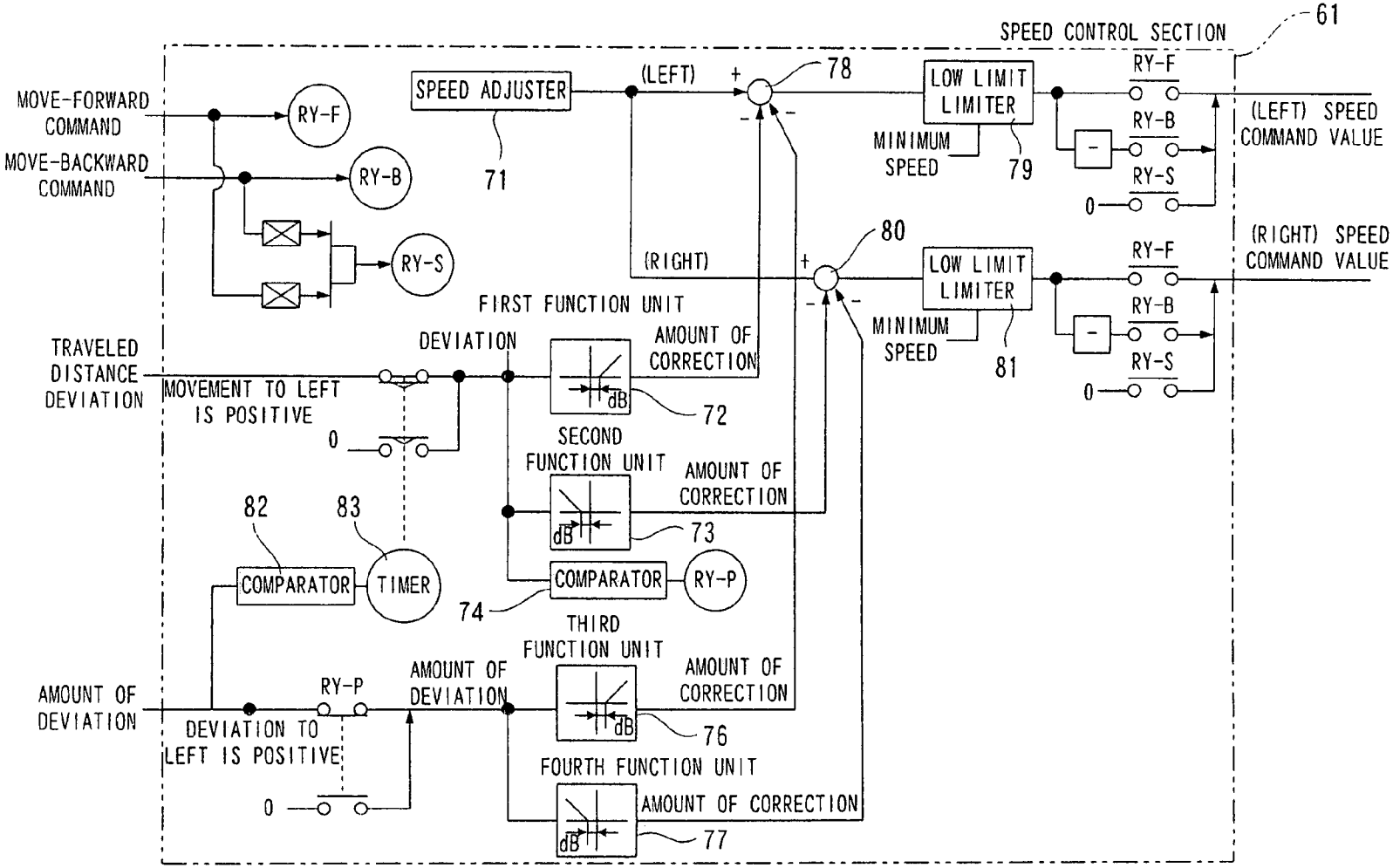
FIG. 10 is a control block diagram of a controller of each movable shelf of the shelving system.

FIG. 10 shows a detailed block diagram of the speed control section 61.

As shown in FIG. 10, the speed control section 61 is configured by a relay RY-F, a relay RY-B, a relay RY-S, a speed adjuster 71, a first function unit 72, a second function unit 73, a first comparator 74, a relay RY-P, a third function unit 76, a fourth function unit 77, a second subtracter 78, a first low limit limiter 79, a third subtracter 80, a second low limit limiter 81, a second comparator 82, an off-delay timer 83, and a plurality of logic circuits.

The relay RY-F operates when the move-forward command is input.

The relay RY-B operates when the move-backward command is input.

The relay RY-S operates when both the move-forward command and move-backward command are not input, that is, during the stop command.

The speed adjuster 71 is set with a predetermined traveling speed of the movable shelf 1.

The first function unit 72 is configured so that the traveled distance deviation input from the subtracter 66 is selected (input) when the off-delay timer 83, which will be described later, is turned OFF, and so that the no-distance deviation (deviation=0) is selected (input) when the timer 83 is turned ON, and derives the speed correction amount of the left drive traveling wheel 20A from the selected (input) deviation. Further, when the deviation exceeds a positive predetermined amount (dead band) and becomes positive, the positive speed correction amount is output in proportion therewith.

The second function unit 73, similar to the first function unit 72, is selected (input) with the traveled distance deviation or the no-distance deviation (deviation=0) by the operation of the off-delay timer 83, and derives the speed correction amount of the right drive traveling wheel 20A. Further, when the deviation exceeds a negative predetermined amount (dead band) and becomes negative, the positive speed correction amount is output in proportion therewith.

The first comparator 74 is, similar to the first function unit 72, selected (input) with the traveled distance deviation or the no-distance deviation (deviation=0) by the operation of the off-delay timer 83, and operates when the selected deviation exceeds a positive or negative predetermined amount (dead band), that is, when the speed correction amount is output from the first function unit 72 or the second function 73, and the movable shelf attitude correction control (tilt correction control) is performed.

The relay RY-P is operated by the operation of the first comparator 74.

The third function unit 76 is configured so that the amount of deviation output from the mean value calculating part 67 is selected (input) when the relay RY-P is not operating, and the no-width deviation (amount of deviation=0) is selected (input) when the relay RY-P is operating, and derives the speed correction amount of the left drive traveling wheel 20A from the selected amount of deviation. Further, when the amount of deviation exceeds a positive (width deviation to the left) predetermined amount (dead band) and becomes positive, the positive speed correction amount is output in proportion therewith.

The fourth function unit 77 is, similar to the third function unit 76, selected (input) with the amount of deviation or no-displacement (amount of deviation=0) by the operation of the relay RY-P to derive the right speed correction amount of the right drive traveling wheel 20A. Further, when the deviation exceeds a negative predetermined amount (dead band) and becomes negative, a positive speed correction amount is output in proportion therewith.

The second subtracter 78 subtracts the positive speed correction amount output from the first function unit 72 and the third function unit 73 from the predetermined traveling speed of the movable shelf 1 set in the speed adjuster 71, and derives the speed command value of the left drive traveling wheel 20A.

The first low limit limiter 79 limits the lower limit of the speed command value of the left drive traveling wheel 20A obtained from the second subtracter 89 and guarantees the minimum speed, the output thereof being selected to be the speed command value of the left drive traveling wheel 20A in which the lower limit is limited by the operation (turned ON by the move-forward command) of the relay RY-F. Thereafter, it is configured so that a value in which the speed command value of the left drive traveling wheel 20A in which the lower limit is limited by the operation (turned ON by the move-backward command) of the relay RY-B is negative is selected, the speed command value "0" of the left drive traveling wheel 20A is selected by the operation (turned ON by the stop command) of the relay RY-S, and the speed command value is output to the left inverter 37.

The third subtracter 80 subtracts the speed correction amount output from the second function unit 73 and the fourth function unit 77 from the predetermined traveling speed of the movable shelf 1 set in the speed adjuster 71, and derives the speed command value of the right drive traveling wheel 20A.

The second low limit limiter 81 limits the lower limit of the speed command value of the right drive traveling wheel 20A obtained from the third subtracter 80 and guarantees the minimum speed, which output being selected as the speed command value of the right drive traveling wheel 20A in which the lower limit is limited by the operation (turned ON by the move-forward command) of the relay RY-F. Thereafter, it is configured so that a value in which the speed command value of the right drive traveling wheel 20A in which the lower limit is limited by the operation (turned ON by the move-backward command) of the relay RY-B is negative is selected, the speed command value "0" of the right drive traveling wheel 20A is selected by the operation (turned ON by the stop command) of the relay RY-S, and the speed command value is output to the right inverter 37.

The second comparator 82 is operated when the amount of deviation input from the mean value calculating block 67 to the speed control section 61 exceeds the positive or negative predetermined amount (dead band of the function units 76, 77).

The off-delay timer 83 is operated by the operation of the second comparator 82.

Here, the speed command value indicates a speed command value for the forward movement when positive, and the speed command value for the backward movement when negative.

Due to the configuration of the speed control section 61, normally, when the move-forward command or the move-backward command is input to the speed control section 61, based on the traveled distance deviation of both left and right ends arranged with the movement detector 19, the movable shelf attitude control is performed that outputs the speed command value with the speed difference between the two motors 24 to eliminate the traveled distance deviation, that is, to have the attitude of the movable shelf 1 at right angles to the travel path i. When the amount of deviation in the right-and-left direction reaches a predetermined amount and the second comparator 82 is operated, the movable shelf width deviation correction control is performed that outputs the speed command value with a speed difference between the two motors 24 to eliminate the amount of deviation in preference to the movable shelf attitude control. When the amount of deviation in the right-and-left direction falls within the predetermined amount due to such movable shelf width deviation correction control, the movable shelf attitude control is again performed after a time set by the timer 83.

The function by the configuration of the shelving system will now be explained. As shown in FIG. 2, the working aisle S3 is formed between the No. 2 and No. 3 movable shelves 1. Here, each of the approach detectors 31 at the front and the back of the No. 1 movable shelf 1 and the approach detector 31 of the No. 3 movable shelf 1 are operated (turned ON).

The worker can thereby open the working aisle S02 and carry out the task.

The worker first checks that there is no one in the working aisle S3, and operates the S2 operation button 35 of the No. 1 movable shelf 1. The controller 36 of the No. 1 movable shelf 1 then, in response to the S2 operation button 35, outputs the move-backwards command to the controller 36 of the No. 1 movable shelf 1 of itself (at the back), and outputs the move-forward command to the controllers 36 of the No. 2 and No. 3 movable shelves 1 at the front. Since the back approach detector 31 of the No. 1 movable shelf 1 is turned ON, the No. 1 movable shelf 1 remains stopped without moving backwards, and further, since the approach detector 31 of the No. 3 movable shelf 1 is turned ON, the No. 3 movable shelf 1 remains stopped without moving forward.

The No. 2 movable shelf 1 starts to move forward. While the worker operates the S2 operation button 35, a command is output to the controller 36 of each movable shelf 1, and when the worker stops the operation of the S2 operation button 35, the command is turned OFF and the No. 2 movable shelf 1 comes to a stop.

Since the traveled distance deviation and the amount of deviation are input to the speed control section 61 while the No. 2 movable shelf 1 is moving forward, the speed of the two motors 24 is controlled so as to correct the attitude of the movable shelf 1 from the above-mentioned traveled distance deviation and to eliminate the amount of deviation.

When the No. 2 movable shelf 1 moves forward and the forward approach detector 31 of the No. 2 movable shelf 1 is turned ON, the move-forward command is turned OFF, and the No. 2 movable shelf 1 approaches the No. 3 movable shelf 1 and stops, thereby opening the working aisle S2. Further, the move-backward command is output from the controller 36 of the No. 2 movable shelf 1 to the controller 36 of the No. 3 movable shelf 1.

The worker, when the working aisle S2 is formed, enters the working aisle S2 and performs the article handling task.

When the worker stops the operation of the operation button 35 and the operation command thereof is turned OFF, the move-forward command and the move-backward command to the speed control section 61 (inverter 37) are turned OFF, and the movable shelf 1 comes to a stop. In this way, by stopping the operation of the operation button 35 while the movable shelf 1 is moving and stopping the movement of the movable shelf 1, the S2 or S3 aisle to which the worker can enter is formed as he or she pleases. Even if the movable shelf 1 is stopped while the working aisle S is being formed, and for example, when the S2 aisle and the S3 aisle are formed, the moving direction of the movable shelf 1 moved in accordance with the opened working aisle S is determined in response to the operation of the operation button 35, and the speed control section 61 (inverter 37) is controlled by the determined moving direction, thus allowing the target working aisle S to be formed.

According to the above-mentioned embodiment, the absolute coordinates, that is, the above-mentioned $(X_L, Y_L)$ and $(X_R, Y_R)$ of the position of each movement detector 19 (right and left direction) of each movable shelf 1 are obtained by the moved distance x in the front-and-back direction A and the moved distance y in the right-and-left direction B for every unit time each detected by each movement detector 19 (right-and-left direction) of each movable shelf 1. The deviation in the left-right direction B from the travel path i of the movable shelf 1 is corrected based on the amount of deviation in the right-and-left direction of such absolute coordinates involved in the traveling of the movable shelf 1, thereby allowing the width deviation correction control of the movable shelf 1 to be accurately performed. Further, as the positional deviation (i.e., tilt of the attitude of the movable shelf 1) in the travel direction of each movement detector 19 is corrected so as to be at right angles to the front-and-back direction A based on the positional deviation (i.e., traveled distance deviation) in the travel direction of the absolute coordinates, the attitude control of the movable shelf 1 can be accurately performed. Further, the detection-subjected body (e.g., magnetic tape 91) laid along the travel path i and the detector (e.g., magnetic sensor 93) for detecting the detection-subjected body, as in the conventional art, become unnecessary, and thus the cost can be reduced.

According to the present embodiment, the intensity of the light received by the image pickup device 53 is adjusted by the adjusting circuit 56 so as to be constant and the current value supplied to the light emitting diode 51 is controlled based on the illuminance of the floor 2 detected by the photosensor 55. In such way, as the intensity of the light irradiated by the light emitting diode 51 is adjusted, the contrast of the fine projections 2*a* and depressions 2*b* of the floor 2 can be maintained constant even if the illuminance of the floor 2 is changed. Therefore, even if the threshold value for digitalizing the image pickup signal of the image pickup device 53 is a fixed value, the possibility of distinguishing or not distinguishing the fine projections 2*a* or depressions 2*b* of the floor 2 by the contrast (illuminance) can be avoided, thereby forming a stable contrast pattern and allowing a stable tracking of the projection 2*a* and the depression 2*b*. The detection error can be also reduced.

According to the present embodiment, the light L diagonally irradiated to the floor 2 by the light emitting diode 51 is reflected at the floor 2 at approximately 90 degrees, and received by the image pickup device 53. Thus, the light L reflected by the floor 2 is most efficiently received by the image pickup device 53, and the difference between the light received by the image pickup means and the light not traveling towards the image pickup device 53 due to the fine projections 2*a* or depressions 2*b* of the floor 2 become clear. Therefore, the precision for detecting the fine projections 2*a* or depressions 2*b* of the floor 2 can be improved.

According to the present embodiment, the direction of the light L irradiated by the light emitting diode 51 coincides with the travel direction (front-and-back direction A) of the movable shelf 1, and thus the fine projections 2*a* or depressions 2*b* of the floor 2 are continuously detected in a long range in the travel direction (front-and-back direction A) of the movable shelf 1, thereby allowing smooth detection of the moved distance x in the travel direction.

In the present embodiment, the width deviation correction control and the attitude control of the movable shelf 1 are performed, but the traveling deviation from the target traveling position of the movable shelf 1 may be corrected, that is, positional control of the movable shelf 1 may be performed. Here, when the absolute moved distance of the movable shelf 1 is obtained from the mean value of the absolute coordinates $X_L$, $X_R$ in the front-and-back direction A of each movement detector 19, and the target traveling distance to the target traveling position is set, the deviation between the set value and the absolute moved distance of the movable shelf 1 is obtained, and the speed command value is output to the inverter 37 so that such deviation becomes "0".

In the present embodiment, the movement detector 19 serving as the movement detecting means is arranged on both ends in the right-and-left direction B of the movable shelf 1, but is not limited to both ends and only needs to be in the right-and-left direction B, and is not limited to two, and more than two movement detectors 19 may be arranged on the movable shelf 1 to obtain the absolute coordinates of theses movement detectors 19 to perform the width deviation correction control and the attitude control, or the positional control of the movable shelf 1.

In the above-mentioned embodiment, the shelving system is configured so that a plurality of movable shelves 1 is arranged between the fixed shelves 5 at the front and the back, but considering the configuration in which a plurality of movable shelves 1 is arranged between the front and back fixed shelves 5 as one block, the shelving system may be configured by a plurality of such blocks. The configuration may also be such that a plurality of movable shelves 1 is arranged between the walls with a space for the working aisle S (configuration without the fixed shelves 5 on both sides or configuration without one of the fixed shelf 5).

In the present embodiment, the power box 41 is arranged in the fixed shelf 5, but is not limited to the fixed shelf 5, and the power box 41 may be arranged on the movable shelf 1 or the wall surface of a warehouse and the like in which such shelving system is installed.

In the present embodiment, the photoelectric switch serving as the approach detector 31 is used, but is not limited to the photoelectric switch, and may be any as long the approach of the movable shelf 1 or the fixed shelf 5 is detected. The magnetic sensor, for example, may be used. When the magnetic sensor is used, an object for generating a magnetic force such as a magnet is attached to the surface of the movable shelf 1 or the fixed shelf 5 facing the magnetic sensor.

In the present embodiment, the article accommodating section 14 of a type for carrying out placement and accommodation of the article F by way of the palette P is proposed on the assumption that it is installed in the warehouse for handling the article F with the cargo vehicle G such as a fork lift, but may be a type in which the article F or a case is directly placed and accommodated on the assumption that it is installed in the business office.

In the present embodiment, the article accommodating section 14 is formed in the up-and-down direction and in the right-and-left direction by the supporting columns 11, the front-and-back frames 12 and the right-and-left frames 13, but the article accommodating section 14 may be a type other than the above type. For example, it may be a type in which the article accommodating section 14 is formed in the up-and-down direction and in the left-right direction by the supporting column 11 and the shelf plate 12, or a type in which only one step of article accommodating section 14 is formed.

In the present embodiment, the traveling wheel 20 serving as the traveling supporting device is shown, but may also be a caterpillar type (roller chain type).

In the present embodiment, the intensity of the light received by the image pickup device 53 is adjusted by the adjusting circuit 56 so as to be constant, the current value supplied to the light-emitting diode 51 is controlled, and the intensity of the light irradiated by the light-emitting diode 51 is adjusted based on the illuminance of the floor 2 detected by the photosensor 55, but the signal level (threshold value) for digitalizing the image pickup signal of the image pickup device 53 of the distance detector 54 may be adjusted based on the illuminance of the floor 2 detected by the photosensor 55. With such configuration as well, the possibility of distinguishing or not distinguishing the fine projection 2*a* or depression 2*b* of the floor 2 by contrast (illuminance) can be avoided, thereby forming a stable contrast pattern, and allowing a stable tracking of the projections 2*a* or depressions 2*b*. Further, the detection error is reduced.

The invention claimed is:

1. A shelving system comprising a plurality of movable shelves installed for back-and-forth movement on a travel path through a travel supporting device thereby to handle articles with respect to the movable shelves opposed to a working aisle by using the working aisle opened between the movable shelves, wherein the system further comprises:

at least two movement detecting means for detecting a moved distance in a travel direction and a moved distance in a right-and-left direction for every unit time, said means being provided in the right-and-left direction at right angles to the travel direction along the travel path of each movable shelf; and control means for finding absolute coordinates of each movement detecting means from the moved distance in the travel direction and the moved distance in the right-and-left direction each detected by each movement detecting means, correcting a deviation in the right-and-left direction from the travel path of the movable shelves involved in the traveling of the movable shelf or the deviation in the travel direction of the movable shelf based on the absolute coordinates, and correcting an attitude of the movable shelf in a direction at right angles to the travel direction or in the travel direction.

2. The shelving system according to claim 1, wherein the movement detecting means comprises:

light projecting means for diagonally irradiating light to a floor having the movable shelf arranged thereon;

image pickup means for receiving the light irradiated by the light projecting means and reflected by the floor, and picking up an image of a fine projection or depression of the floor; and a distance detecting means for detecting the moved distance in the travel direction and the moved distance in the right-and-left direction for every unit time by tracking the movement of the position of the fine projection or depressions of the floor picked up by the image pickup means.

3. The shelving system according to claim 2, wherein the movement detecting means comprises:

light detecting means for detecting an illuminance of the floor having the movable shelf arranged thereon; and adjusting means for adjusting an intensity of the light irradiated by the light projecting means so that the intensity of the light received by the image pickup means becomes constant based on the illuminance of the floor detected by the light detecting means.

4. The shelving system according to claim 2, wherein the light projecting means and the image pickup means are arranged so that an angle formed by the light irradiated by the light projecting means and the light received by the image pickup means is approximately 90 degrees.

5. The shelving system according to claim 2, wherein the light projecting means is arranged so that the direction of the light irradiated by the light projecting means coincides with the travel direction of the movable shelves.

* * * * *